United States Patent [19]

Kamikawa

[11] Patent Number: 4,894,042

[45] Date of Patent: Jan. 16, 1990

[54] FLIP-OVER TOY VEHICLE

[75] Inventor: Hiromi Kamikawa, Tokyo, Japan

[73] Assignee: Maple Toys International Ltd., Hong Kong

[21] Appl. No.: 196,018

[22] Filed: May 19, 1988

[30] Foreign Application Priority Data

Nov. 19, 1987 [JP] Japan ..... 62-176699

[51] Int. Cl.[4] ..... A63H 17/00; A63H 17/26

[52] U.S. Cl. ..... 446/437; 446/466

[58] Field of Search ..... 446/437, 431, 441, 444, 446/465, 466, 464

[56] References Cited

U.S. PATENT DOCUMENTS

| | | | |
|---|---|---|---|
| 4,591,346 | 5/1986 | Ikeda | 446/437 |
| 4,666,420 | 5/1987 | Nagano | 446/437 |
| 4,680,021 | 7/1987 | Maxim | 446/437 |
| 4,702,720 | 10/1987 | Konta et al. | 446/437 |

FOREIGN PATENT DOCUMENTS

| | | | |
|---|---|---|---|
| 0133054 | 7/1985 | European Pat. Off. | 446/437 |
| 0187895 | 7/1986 | European Pat. Off. | 446/437 |
| 2114012 | 8/1983 | United Kingdom | 446/437 |
| 2164263 | 6/1985 | United Kingdom | 446/437 |

*Primary Examiner*—Robert A. Hafer
*Assistant Examiner*—Michael Brown
*Attorney, Agent, or Firm*—Browning, Bushman, Zamecki & Anderson

[57] ABSTRACT

A toy vehicle that has a vehicle body, a spring or inertia wheel motor, driven and non-driven wheels, and a spring loaded flip-over device operable by a non-driven wheel of the vehicle. The flip-over device is movable from a first to a second position to cause the toy vehicle to flip-over. A latching device is provided for releasably holding the flip-over device in its first position and a release mechanism is operable by a non-driven wheel to release the latching device.

6 Claims, 3 Drawing Sheets

FLIP-OVER TOY VEHICLE

FIELD OF THE INVENTION

This invention relates to a flip-over toy vehicle.

SUMMARY OF THE INVENTION

According to a first aspect of the invention there is provided a flip-over toy vehicle comprising a vehicle body, wheels supported for rotation relative to the body, a spring loaded flip-over device movable relative to the body between a first position and a second position to cause the toy vehicle to flip-over, a latching device for releasably holding the flip-over device in its first position, and a release mechanism operable by a wheel for releasing the latching device.

Preferred and/or optional features of the first aspect of the invention are set forth in claims 2 to 8, inclusive.

According to a second aspect of the invention there is provided a flip-over toy vehicle comprising a vehicle body, a spring or inertia wheel motor, driven and non-driven wheels, and a spring loaded flip-over device operable by a non-driven wheel of the vehicle.

DESCRIPTION OF A PREFERRED EMBODIMENT

Figure 1:
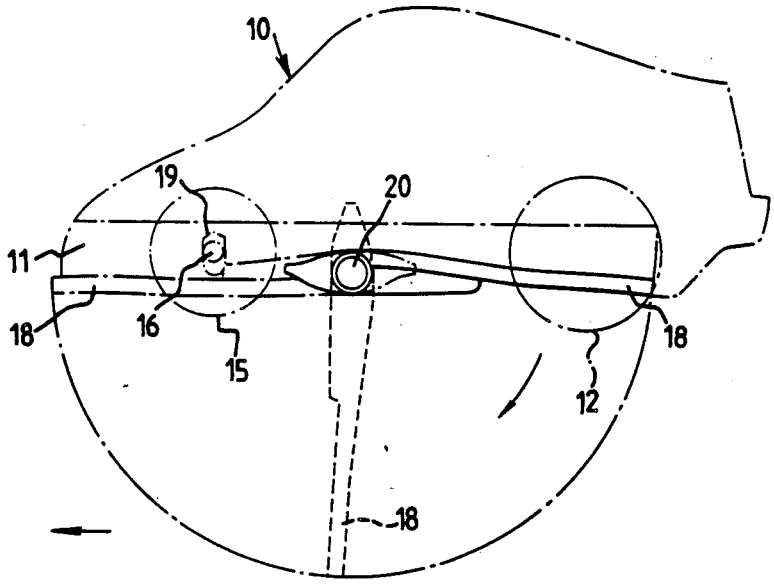
FIG. 1 is a side view of one embodiment of a toy vehicle according to the present invention.

Referring now to the drawings, the toy vehicle shown therein comprises a body 10 including a base part or chassis 11, two driven wheels 12 fixed to a rear axle 13, an inertia wheel motor 14 for rotating the axle 13, two non-driven wheels 15 fixed to a front axle 16, and a flip-over mechanism 17 including a flip-over device in the form of an arm 18.

As shown in FIG. 1, the front axle 16 is mounted in aligned elongate slots 19 in the chassis 11 for limited vertical movement relative to the chassis 11 and the flip-over arm 18 is mounted for pivotable movement about a transverse axis 20 between a first position (shown in full lines) and a second position (shown in dash-dot lines) *via* an intermediate position (shown in dashed lines).

Figure 2:
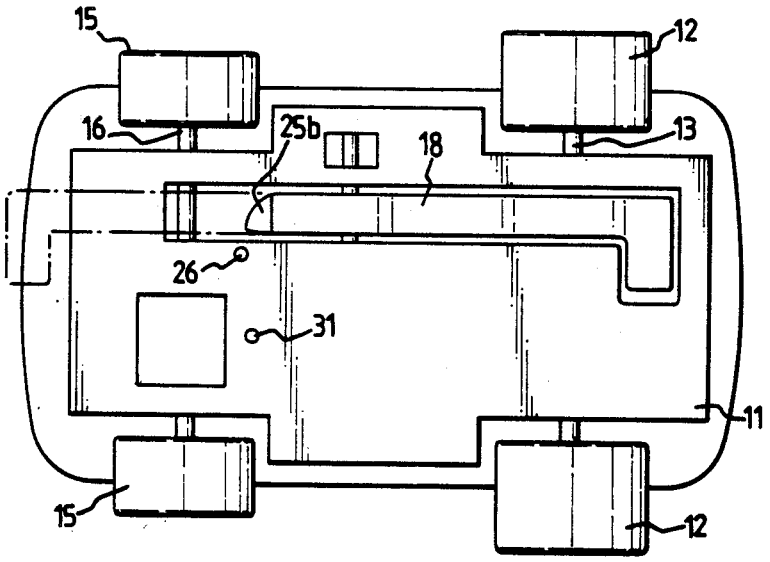
FIG. 2 is an underneath plan view of the toy vehicle shown in FIG. 1.
Figure 4:
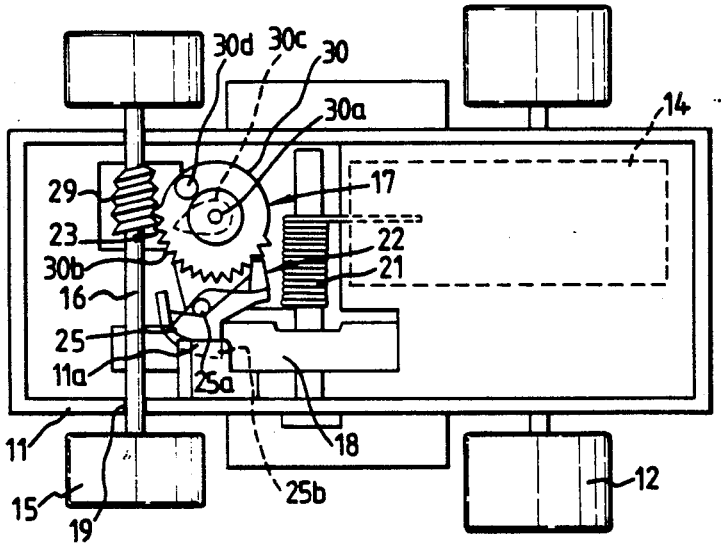
FIG. 4 is a view similar to FIG. 3 but with a cover over the flip-over mechanism removed.
Figure 5:
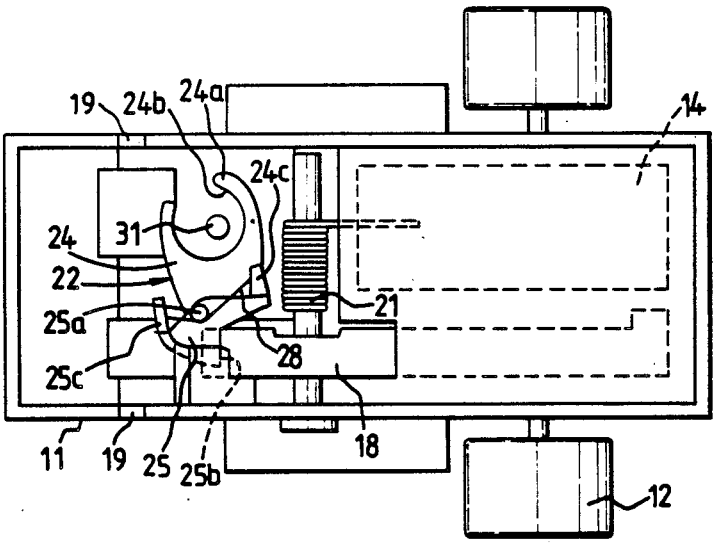
FIG. 5 is a view similar to FIG. 4 but with the front axle and release mechanism removed.

As shown in FIG. 2, the flip-over arm 18 is mounted to one side of a centre line of the chassis 11 so that as the arm 18 moves from its first to its second position the toy vehicle is caused to flip-over sideways and as shown in FIGS. 4 and 5 the flip-over arm 18 is spring loaded in its first position by a torsion spring 2.

Figure 3:
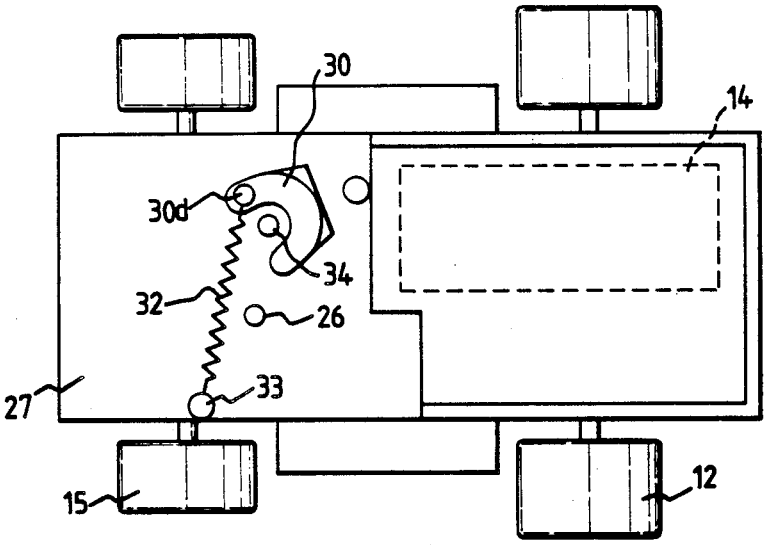
FIG. 3 is a plan view of a base part of the toy vehicle shown in FIGS. 1 and 2.

As shown in FIGS. 3 to 5, the flip-over mechanism 17 also comprises a latching device 22 for releasably holding the fold-over arm 18 in its first position, and a release mechanism 23 operable by the non-driven wheels 15 for releasing the latching device 22. The latching device 22 comprises first and second parts 24 and 25, respectively. The first part 24 is in the form of a plate-like member having a bifurcated end **24*a* defining an arcuate recess 24*b* and an upstanding pillar 24*c* of inverted L-shape. The second part 25 comprises a post 25*a*, a cam portion 25*b*, and an upstanding abutment 25*c*** of inverted L-shape.

The post **25*a* is journalled in holes 26 in the chassis 11 and in a removable cover 27 and passes through an aperture (not shown) in the plate-like part 24. A torsion spring 28 is mounted about the post 25*a* and opposite ends of the torsion spring 28 respectively engage with the pillar 24*c* and the abutment 25*c* beneath horizontal limbs thereof. The cam portion 25*b* is located below an overhanging portion 11*a* of the chassis and the part 25 can move clockwise relative to the plate-like part 24 against the urging force of the torsion spring 28** for a purpose which will become apparent later.

The release mechanism 23 comprises a worm 29 fixed to the front axle 16, and a release member 30 having coaxial stub shafts **30*a* journalled for angular movement in holes 31 in the chassis 11 and in the cover 27, a toothed sector 30*b* engageable with the worm 29 when the axle 16 is in a raised position in elongate slots 19, an operating arm 30*c* located in the arcuate recess 24*b* of the bifurcated end 24*a* of the plate-like part 24, and an upstanding pillar 30*d*. A tension spring 32 is connected between a pillar 33 on the cover 27 and the pillar 30*d* to urge the release member 30 towards the position shown in FIGS. 3 and 4. In this position, the cam portion 25*b* will hold the flip-over arm 18 in its first position against the urgig force of the torsion spring 21**.

When the toy vehicle is driven forwards by the inertia wheel motor 14 and the front axle 16 is raised in the slots 19 by the reaction force between the wheels 15 and ground, the worm 29 will be in mesh with the toothed sector **30*b* and the release member 30 will turn clockwise as viewed in FIGS. 4 and 5 against the urging force of tension spring 32 which will stretch around a post 34 (see FIG. 3). After a certain angular displacement the operating arm 30*c* will come into contact with the right hand part of the bifurcated end 24*a* of latching device 22 and further angular displacement of the operating arm 30*c* in a clockwise direction will effect associated clockwise movement of the latching device 22. Eventually the cam portion 25*b* of the part 25 of the latching device 22 will move out of engagement with the flip-over arm 18 and the latter will move under the urging force of the torsion spring 21 from its first to its second position (see FIG. 1**) to cause the vehicle to flip-over.

When the wheels 15 leave contact with the ground, the axle 16 will drop down towards the lower end of the elongate slots 19 and the worm 29 will disengage from the toothed sector **30*b*. The release member 30 will then return under the urging force of the tension spring 32 to its position shown in FIGS. 3 and 4 and the latching device 22 will be returned to its latching position shown in FIG. 5 by engagement between the operating arm 30*c* and the left hand part of the bifurcated end 24*a***.

The flip-over arm 18 can then be returned manually to its first position and during this movement of the flip-over arm 18 the part 25 of the latching device 22 will move relative to the part 24 against the urging force of the torsion spring 28 to allow the arm 18 to pass the cam portion **25*b***.

Thus with the above arrangement the release mechanism 17 and latching device 22 will reset automatically. Furthermore, the above arrangement has the advantage that when used with an inertia wheel motor which requires the driven wheels to be pushed along the ground to give the motor the desired inertia to move the toy vehicle, the flip-over mechanism will remain inoperable provided the non-driven wheels are kept off the ground. Also if used with a spring motor requiring the driven wheels to be moved rearwardly along the ground to wind up the motor the above arrangement will allow the flip-over mechanism to be disengaged during motor wind up so as to avoid damage to the flip-over mechanism.

The above embodiment is given by way of example only and various modifications will be apparent to persons skilled in the art without departing from the scope of the invention defined by the appended claims.

What is claimed is:

1. A flip-over toy vehicle, comprising a vehicle body, wheels supported for rotation relative to the body, at least one of the wheels being connected to a motor for driving said wheel and at least one other of said wheels being a non-driven wheel, a spring-loaded flip-over device connected to the body and movable relative to the body between a first and a second position to cause the toy vehicle to flip over, a rotatable latching device for releasably holding the spring-loaded flip-over device in its first position, and a release mechanism for releasing the latching device, said non-driven wheel being mounted for rotation with a worm, the release mechanism having a toothed gear engageable with the worm and an operating arm connected to the toothed gear, the latching device including a birfurcated arm having bifurcations for interacting with the operating arm of the release mechanism such that upon rotation of the non-driven wheel the operating arm of the release mechanism acts to unlatch the flip-over device.

2. A flip-over toy vehicle as claimed in claim 1, further comprising spring means for urging the release mechanism towards a position such that the latching device is moved into a latching position.

3. A flip-over toy vehicle as claimed in claim 1 or claim 2, wherein the motor is selected from a group consisting of a spring and an inertia wheel motor, and the release mechanism being operable by the non-driven wheel.

4. A flip-over vehicle as claimed in claim 3, wherein the non-driven wheel is mounted for limited vertical movement relative to the vehicle body, and wherein the non-driven wheel is coupled to the release mechanism when the wheel is in a raised position and uncoupled from the release mechanism when in a lower position.

5. A flip-over toy vehicle as claimed in claim 1, wherein the latching device comprises first and second parts each movable relative one to the other against the urging force of the spring-loaded flip-over device to allow the flip-over device to return to its first position.

6. A flip-over toy vehicle as claimed in claim 1, wherein the spring-loaded flip-over device includes an arm shaped member mounted to a side of a base of the vehicle body for pivotable movement about an axis transverse to the intended direction of movement of the vehicle.

* * * * *